US006993882B2

(12) United States Patent
Crawford et al.

(10) Patent No.: US 6,993,882 B2
(45) Date of Patent: Feb. 7, 2006

(54) TRUSS SPACER AND BRACE

(75) Inventors: Mark G. Crawford, Visalia, CA (US); Louay A. Shamroukh, Walnut Creek, CA (US); Jin-Jie Lin, Livermore, CA (US)

(73) Assignee: Simpson Strong-Tie Company, Inc., Dublin, CA (US)

( * ) Notice: Subject to any disclaimer, the term of this patent is extended or adjusted under 35 U.S.C. 154(b) by 0 days.

(21) Appl. No.: 09/729,507

(22) Filed: Dec. 3, 2000

(65) Prior Publication Data

US 2002/0092259 A1 Jul. 18, 2002

(51) Int. Cl.
*E04C 3/02* (2006.01)

(52) U.S. Cl. ..... 52/696

(58) Field of Classification Search ..... 52/696, 52/693, 690, 712, 317, 643, 677
See application file for complete search history.

(56) References Cited

U.S. PATENT DOCUMENTS

| | | | |
|---|---|---|---|
| 651,139 | A | 6/1900 | Gays |
| 688,230 | A | 12/1901 | Isrig et al. |
| 1,106,845 | A | 8/1914 | Ream |
| 1,204,956 | A | 11/1916 | Day |
| 1,214,738 | A | 2/1917 | Wolf |
| 1,378,448 | A | 5/1921 | Gilbert |
| 1,458,498 | A | 6/1923 | Piel |
| 1,461,704 | A | 7/1923 | Bonsall |
| 1,514,577 | A | 11/1924 | Burrell |
| 1,523,970 | A | 1/1925 | Jakob |
| 1,533,041 | A | 4/1925 | Slater |
| 1,558,239 | A | 10/1925 | Carline |

(Continued)

FOREIGN PATENT DOCUMENTS

| | | | | |
|---|---|---|---|---|
| AU | 484192 A1 | | 6/1974 | |
| CA | 502492 | | 5/1954 | |
| DE | 298 19 351.5 | | 3/1999 | |
| EP | 1 213 399 | * | 6/2002 | ..... 52/643 |
| GB | 2 039 582 | | 8/1980 | |
| GB | 2 163 788 A | | 3/1986 | |
| GB | 2 225 955 A | | 9/1990 | |
| WO | WO96/29180 A1 | | 9/1996 | |

OTHER PUBLICATIONS

META/HETA/HHETA/HETAL/TSS Embedded Truss Anchors and Truss Seat Snap–In. Simpson Strong–Tie Wood Connectors Catalog, p. 108. Simpson Strong–Tie Company, Inc., 1999.

"Hulbånd, vindtrækbånd, båndstrammer, båndspænder." BMF Handvaerkerkatalog 1989, Section 4, pp. 4.00.0—4.11.1. BMF Bygningsbeslag A/S. Odder Denmark. 1989.

"Lochbänder," "Lochblechstreifen," "Spanngerät" and "Spanngerät Typ 60." BMF product brochure, pp. 5, 8. BMF Baubeschläge GmbH & Co. KG. Denmark 1990.

(Continued)

*Primary Examiner*—James O. Hansen
(74) *Attorney, Agent, or Firm*—James R. Cypher; Charles R. Cypher

(57) ABSTRACT

The present invention provides an apparatus for spacing structural members, in particular roof trusses, during construction and for permanently bracing the same structural members. The apparatus comprises three longitudinal members with a top attachment tab at each end that is fastened to the top side of each structural member and a pair of flanges at each end that are fastened to the facing sides of each structural member. In particular, the apparatus includes portions that reinforce the ends of ends of the second and third longitudinal members. The apparatus is preferably made in a length that is standard for spacing roof trusses, most commonly a nominal 24". This allows the apparatus to be attached to one roof truss, then another, and left to form permanent bracing over which roof sheathing can be laid.

16 Claims, 8 Drawing Sheets

U.S. PATENT DOCUMENTS

| | | | | |
|---|---|---|---|---|
| 1,614,334 | A | | 1/1927 | Wright |
| 1,656,741 | A | | 1/1928 | Lane |
| 1,685,729 | A | | 9/1928 | Stone |
| 1,880,480 | A | | 10/1932 | Ragsdale |
| 2,037,736 | A | | 4/1936 | Payne |
| 2,042,370 | A | | 5/1936 | Walker |
| 2,116,263 | A | | 5/1938 | Harbaugh |
| 2,302,101 | A | | 11/1942 | Boydstun |
| 2,338,435 | A | | 1/1944 | Hoyt |
| 2,567,586 | A | | 9/1951 | Werder |
| 2,619,887 | A | | 12/1952 | Burrows |
| 2,686,959 | A | | 8/1954 | Robinson |
| 2,806,495 | A | | 9/1957 | Merkle et al. |
| 2,856,646 | A | | 10/1958 | Latimer et al. |
| 2,947,119 | A | | 8/1960 | Puckett, Jr. |
| 2,963,127 | A | | 12/1960 | Manville |
| 2,964,807 | A | | 12/1960 | Kennedy |
| 3,000,145 | A | | 9/1961 | Fine |
| 3,010,162 | A | | 11/1961 | Kelin |
| 3,011,229 | A | | 12/1961 | Mutchnik |
| 3,152,671 | A | * | 10/1964 | Mallory, Jr. ..... 52/643 |
| 3,201,874 | A | | 8/1965 | Christy |
| 3,332,196 | A | | 7/1967 | Tuttle |
| 3,335,993 | A | | 8/1967 | Tuttle |
| 3,389,885 | A | | 6/1968 | Friedman et al. |
| 3,422,585 | A | | 1/1969 | Dismukes |
| 3,467,418 | A | | 9/1969 | Redditt |
| 3,591,997 | A | | 7/1971 | Tennison et al. |
| 3,875,719 | A | | 4/1975 | Menge |
| 3,959,945 | A | | 6/1976 | Allen |
| 3,988,872 | A | | 11/1976 | Adamson et al. |
| 4,016,698 | A | | 4/1977 | Rogers |
| 4,040,232 | A | | 8/1977 | Snow et al. |
| 4,171,172 | A | | 10/1979 | Johnston |
| 4,234,174 | A | | 11/1980 | Cardono |
| 4,237,614 | A | | 12/1980 | Williams |
| 4,246,736 | A | | 1/1981 | Kovar et al. |
| 4,253,224 | A | | 3/1981 | Hickman et al. |
| 4,253,649 | A | | 3/1981 | Hewson |
| 4,322,064 | A | | 3/1982 | Jarvis |
| 4,339,903 | A | | 7/1982 | Menge |
| 4,342,177 | A | | 8/1982 | Smith |
| 4,350,279 | A | | 9/1982 | Haley |
| 4,361,999 | A | | 12/1982 | Sidney |
| 4,370,843 | A | | 2/1983 | Menge |
| 4,420,921 | A | | 12/1983 | Hardin |
| 4,422,792 | A | | 12/1983 | Gilb |
| 4,490,956 | A | | 1/1985 | Palacio et al. |
| 4,503,652 | A | | 3/1985 | Turner |
| 4,524,554 | A | | 6/1985 | Simpson |
| 4,563,851 | A | | 1/1986 | Long |
| 4,570,407 | A | | 2/1986 | Palacio et al. |
| 4,604,845 | A | | 8/1986 | Brinker |
| 4,625,415 | A | | 12/1986 | Diamontis |
| 4,637,195 | A | | 1/1987 | Davis |
| 4,669,235 | A | | 6/1987 | Reinen |
| 4,704,829 | A | | 11/1987 | Baumker, Jr. |
| D293,416 | S | | 12/1987 | Krueger |
| 4,712,340 | A | | 12/1987 | Sogge |
| 4,843,726 | A | | 7/1989 | Ward |
| 4,928,867 | A | | 5/1990 | Jensen |
| 4,958,814 | A | | 9/1990 | Johnson |
| 5,031,886 | A | | 7/1991 | Sosebee |
| D318,785 | S | | 8/1991 | Dean |
| 5,129,153 | A | | 7/1992 | Burns, Sr. |
| 5,161,345 | A | | 11/1992 | Sobjack, Sr. |
| 5,315,803 | A | | 5/1994 | Turner |
| 5,324,132 | A | | 6/1994 | Hunter et al. |
| 5,367,853 | A | | 11/1994 | Bryan |
| 5,388,378 | A | | 2/1995 | Frye |
| 5,407,182 | A | | 4/1995 | Hartley |
| 5,412,920 | A | | 5/1995 | Hess |
| 5,490,334 | A | | 2/1996 | Payne |
| 5,502,942 | A | | 4/1996 | Gras et al. |
| 5,555,694 | A | | 9/1996 | Commins |
| 5,606,837 | A | | 3/1997 | Holizlander |
| 5,628,119 | A | | 5/1997 | Bingham et al. |
| 5,638,655 | A | | 6/1997 | Keck |
| 5,699,639 | A | | 12/1997 | Fernandez |
| 5,884,411 | A | | 3/1999 | Raber |
| 5,884,448 | A | | 3/1999 | Pellock |
| 5,899,042 | A | | 5/1999 | Pellock |
| 5,937,531 | A | | 8/1999 | Menk et al. |
| 5,937,608 | A | | 8/1999 | Kucirka |
| 5,992,122 | A | | 11/1999 | Rohrmoser et al. |
| 6,070,336 | A | | 6/2000 | Rodgers |
| 6,155,019 | A | | 12/2000 | Ashton et al. |
| 6,170,218 | B1 | | 1/2001 | Shahnazarian |
| 6,185,898 | B1 | | 2/2001 | Pratt |
| 6,230,466 | B1 | | 5/2001 | Pryor |
| 6,230,467 | B1 | | 5/2001 | Leek |
| 6,463,711 | B1 | | 10/2002 | Callies |
| 6,523,321 | B1 | | 2/2003 | Leek et al. |
| 6,546,678 | B1 | | 4/2003 | Ashton et al. |

OTHER PUBLICATIONS

"BMF Vindafstivningsstem 25." Product brochure. BMF Bygningsbeslag A/S. Odder, Denmark 2000, 2 pages.

"BMF Vindafstivningssystem 40/60." Product brochure. BMF Bygningsbeslag A/S. Odder, Denmark 2000, 2 pages.

"BMF Vindafstivningssystem." BMF Vindafstivningssystem product catalog. BMF Bygningsbeslag A/S. Odder, Denmark 2000.

Schoening, Carl. Declaration regarding wood frame demonstration structure. Executed Feb. 18, 2004.

Zone Four, "Zone Four Seismic Solutions," Zone Four (San Leandro, California), total pages of 26 (Jan. 20, 1997).

Mitek, Inc., "The Stabilizer Truss Brace," Mitek Products, Mitek, Inc. (www.mitekinc.com), p. 1, 2, (publication date unknown).

National Evaluation Service, Inc., "Mitek Stabilizer," Report No. NER–561, National Evaluation Service, Inc. (U.S.A.), p. 1–3, (Jul. 1, 2000).

Tee–Lok Corporation, "TS TST TUC Truss Products," Tee–Lok Wood Connectors, Tee–Lok Corporation (U.S.A.), p. 10, (1995).

Truslock, "Truslock Spacing Tools," Journal of Light Construction, Journal of Light Construction (U.S.A.), (Sep. 1999).

Truswal Systems, "Don't Just Space It," Brace–It, Truswal System (U.S.A.), p. 1, (publication date unknown).

Mike Guertin, "Adjustable Trusss Braces Responses," Journal of Light Construction, Journal of Light Construction (U.S.A.), p. 10, (Mar. 1999).

Rick Arnold and Mike Guertin, "Installing Gable Roof Trusses," Journal of Light Construction, Journal of Light Construction (U.S.A.), p. 37–42, (Dec. 1998).

Truslock, "Space & Brace Trusses Simply By Folding Over," Truslock Spacing Tools, Truslock (U.S.A.), p. 4,.

United Steel Products Company, "TSX Truss Spacer," Kant–Sag, United Steel Products Company (U.S.A.), p. 2, (publication date unknown).

Truss Plate Institute, "Commentary and Recommendatuins fir Handling and Installing BRacing," HIB–91, Truss Plate Institute (U.S.A.), (publication date unknown).

* cited by examiner

TRUSS SPACER AND BRACE

BACKGROUND OF THE INVENTION

The present invention relates generally to an apparatus for spacing structural members during construction and providing permanent bracing between the same structural members. This is particularly valuable when spacing and bracing roof trusses that are pre assembled and lifted into place on top of the underlying structure. Specifically, the present invention can be attached to the top chord of an installed roof truss, another roof truss can then be lifted into place, and the present invention can then be attached to the second roof truss. Because the present invention is manufactured in preselected lengths, it eliminates the need for cutting and handling spacer blocking.

During the construction of a building, the walls are typically built or installed first. Gables and roof truss are then attached to the tops of the walls. These gables and roof trusses support the roof sheathing and give the building structural integrity.

Where snow loads are expected, the roof sheathing is typically plywood or the like, which is nailed to the roof trusses to form the roofing surface to which shingles and hardware are attached. When such heavy loads are not anticipated, lathing strips are sometimes used instead of sheathing. The weight of the roofing material and any expected loads require a supporting structure, which is the primary function of the roof trusses.

In the past, workers have typically spaced and braced roof trusses during construction by temporarily nailing 1"×3" boards across adjacent trusses. When the sheathing is laid over and attached to the trusses, the temporary spacer boards must be removed to allow the sheathing to be nailed to the trusses flush with the sheathing that has already been laid down. Removing these temporary spacer boards is time consuming and they are usually damaged in the process so that they cannot be reused.

A number of manufacturers have addressed some of the basic deficiencies of this traditional construction technique that relies on wood spacer blocking. Truswall Systems manufactures a sheet metal product that provides lateral bracing in predefined lengths that can be used for both temporary construction and permanent structural bracing, eliminating the need to remove temporary braces. Mitek Industries makes a similar product that uses teeth rather than fasteners to connect to the top and side faces of roof trusses.

The present invention improves on the existing prior art by providing, in a preferred embodiment, improved resistance to compression loads and, secondarily, a more secure connection to the structural members that it spaces and braces.

SUMMARY OF THE INVENTION

The present invention provides an apparatus for spacing structural members, in particular roof trusses, during construction and for permanently bracing the same structural members. The apparatus comprises three longitudinal members with a top attachment tab at each end that is fastened to the top side of each structural member and a pair of flanges at each end that are fastened to the facing sides of each structural member. In particular, the apparatus includes portions that reinforce the ends of ends of the second and third longitudinal members. The apparatus is preferably made in a length that is standard for spacing roof trusses, most commonly a nominal 24". This allows the apparatus to be attached to one roof truss, then another, and left to form permanent bracing over which roof sheathing can be laid.

In a preferred embodiment, the apparatus is formed with end tabs that provide for attachment to the sides of the structural members opposite the sides to which the flanges are fastened. This is a more secure attachment than is provided by the prior art.

In a preferred embodiment, the junctures of the flanges are provided with gusset darts that reinforce the junctures. When the connected structural members are made of wood, the flanges eventually bend back under compression loads and the junctures are driven into the sides of the structural members. The gusset darts and the portions of the junctures in between the gusset darts, which bite into the structural members like teeth, prevent movement along the junctures and the connection is changed from one with two pin joints to a columnar connection that resists rotation at the interfaces of the apparatus and the structural members. This allows greater compression loads to be resisted.

In the most preferred embodiment, in addition to the features described above, the three longitudinal members of the present invention form a channel shape that is further reinforced by a longitudinal embossment. Furthermore, the ends of the two longitudinal members that form the sides of the channel are reinforced by portions that are turned to form fourth and fifth longitudinal members. In the most preferred form of the present invention, the junctures between these fourth and fifth longitudinal members curve up to meet the corner at which the lower edges of the flanges meet the side longitudinal members. Furthermore, the inner edges of the fourth and fifth longitudinal members run smoothly into the lower edge of the adjacent flanges.

In the most preferred embodiment, the top tabs and end tabs are provided with fastener openings that enable easier and more precise attachment to the connected structural members.

In an alternate preferred embodiment, the fourth and fifth longitudinal members may be turned out away from the channel shape and join the lower edges of the flanges at either end of the apparatus.

DETAILED DESCRIPTION

Figure 1:
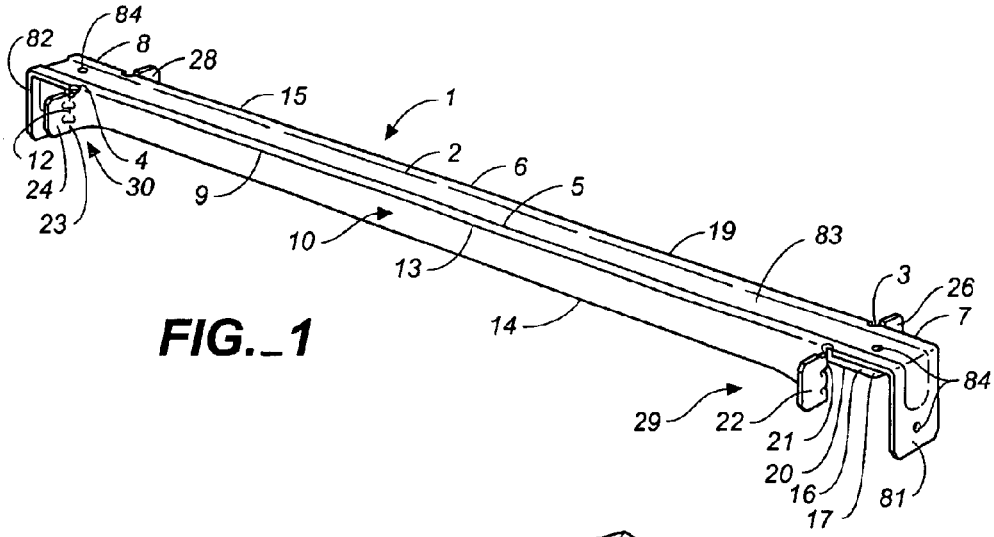
FIG. 1 is a perspective view showing the preferred embodiment of the apparatus of the present invention.

As best shown in FIG. 1 the present invention is preferably an apparatus 1 that comprises a first longitudinal member 2 having a first end 3, a second end 4, a first side 5 and a second side 6, a first top attachment tab 7 joined to the first end 3 and a second top attachment tab 8 joined to the second end 4, a first longitudinal juncture 9 along the first side 5 of the first longitudinal member 2, a second longitudinal member 10, having a first end 11, a second end 12, a first side 13 and a second side 14, joined to the first longitudinal member 2 at the first longitudinal juncture 9, a second longitudinal juncture 15 along the second side 6 of the first longitudinal member 2, and a third longitudinal member 16, having a first end 17, a second end 18, a first side 19 and a second side 20, joined to the first longitudinal member 2 at the second longitudinal juncture 15. This embodiment further comprises a first end juncture 21 along the first end 11 of the second longitudinal member 10, a first flange 22 joined to the second longitudinal 10 member at the first end juncture 21, a second end juncture 23 along the second end 12 of the second longitudinal member 10, a second flange 24 joined to the second longitudinal member 10 at the second end juncture 23, a third end juncture 25 along the first end 17 of the third longitudinal member 16, a third flange 26 joined to the third longitudinal member 16 at the third end juncture 25, a fourth end juncture 27 along the second end 18 of the third longitudinal member 16, and a fourth flange 28 joined to the third longitudinal member 16 at the fourth end juncture 27. This embodiment further comprises a first portion 29 turned out of the second longitudinal member 10 at the first end 11 of the second longitudinal member 10 and reinforcing the first end 11 of the second longitudinal member 10, a second portion 30 turned out of the second longitudinal member 10 at the second end 12 of the second longitudinal member and reinforcing the second end 12 of the second longitudinal member 10, a third portion 31 turned out of the third longitudinal member 16 at the first end 17 of the third longitudinal member 16 and reinforcing the first end 17 of the third longitudinal member 16, and a fourth portion 32 turned out of the second longitudinal member 10 at the second end 18 of the third longitudinal member 16 and reinforcing the second end 18 of the third longitudinal member 16.

The apparatus 1 of the present invention is preferably formed from sheet metal that may be cut, stamped, punched, embossed and bent, but it may be formed from cast metal or any other material that may be molded or otherwise formed to embody the apparatus 1 of the present invention.

The portions 29, 30, 31 and 32 are structures turned out of the ends of the second and third longitudinal members 10 and 16 near or at the junctures 21, 23, 25 and 27 with the four flanges 22, 24, 26 and 28. The four flanges 22, 24, 26 and 28 are turned out of the second and third longitudinal members 10 and 16. In their simplest forms, the portions 29, 30, 31 and 32 preferably are reinforcing members 33, 36, 39 and 42, but the portions 29, 30, 31 and 32 can also include gusset darts 77, 78, 79 and 80 or gussets 90, 91, 92 and 93. As best shown in FIG. 5A, the first portion 29 preferably is a first reinforcing member 33 with an outer edge 34 along part of the second side 14 of the second longitudinal member 10 and an inner edge 35 that terminates at the first end 11 of the second longitudinal member 10, the second portion 30 is a second reinforcing member 36 with an outer edge 37 along part of the second side 14 of the second longitudinal member 10 and an inner edge 38 that terminates at the second end 12 of the second longitudinal member 10, the third portion 31 is a third reinforcing member 39 with an outer edge 40 along part of the second side 20 of the third longitudinal member 16 and an inner edge 41 that terminates at the first end 17 of the third longitudinal member 16, the fourth portion 32 is a fourth reinforcing member 42 with an outer edge 43 along part of the second side 20 of the third longitudinal member 16 and an inner edge 44 that terminates at the second end 18 of the third longitudinal member 16.

Figure 5:
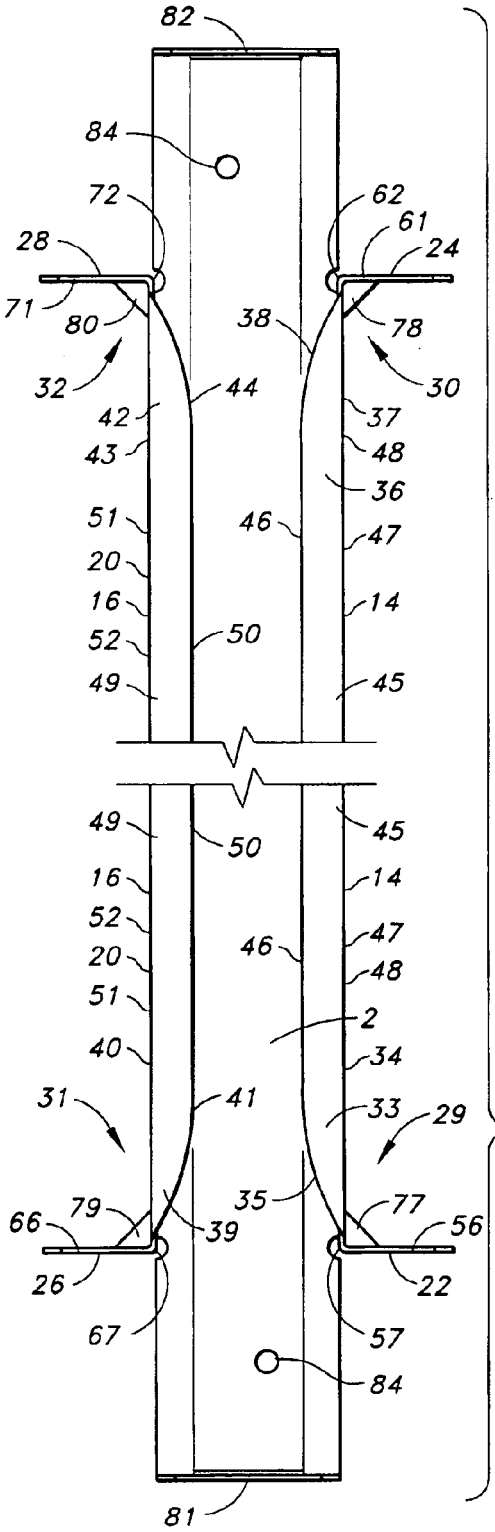
FIG. 5 is a bottom plan view of the preferred embodiment of the apparatus of the present invention.
Figure 6:
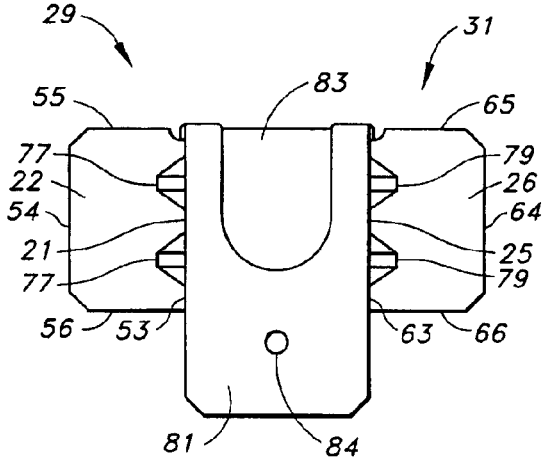
FIG. 6 is an end elevation view of the preferred embodiment of the first end of the apparatus of the present invention.
Figure 5A:
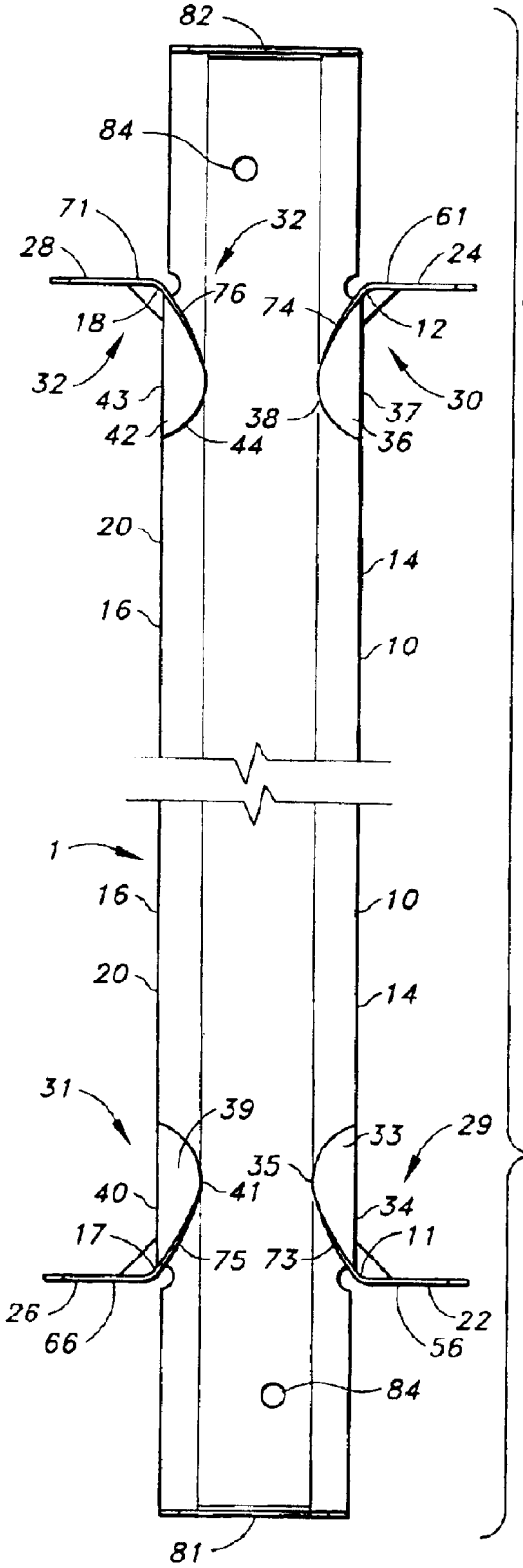
FIG. 5A is a bottom plan view of an alternate preferred embodiment of the apparatus of the present invention.
Figure 6A:
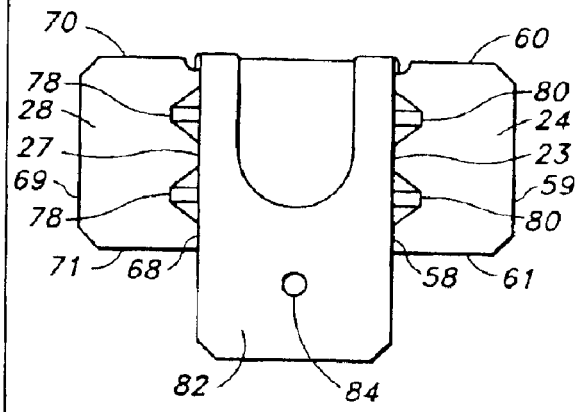
FIG. 6A is an end elevation view of the preferred embodiment of the second end of the apparatus of the present invention.

As best shown in FIGS. 5, 6 and 6A, the first portion 29 preferably further comprises one or more gusset darts 77 in the first end juncture 21, the second portion 30 further comprises one or more gusset darts 78 in the second end juncture 23, the third portion 31 further comprises one or more gusset darts 79 in the third end juncture 25, and the fourth portion 32 further comprises one or more gusset darts 80 in the fourth end juncture 27.

As best shown in FIG. 5A, 6 and 6A, the first flange 22 preferably has an inner edge 53, an outer edge 54, a top edge 55 and a bottom edge 56, the inner edge 35 of the first reinforcing member 33 and the bottom edge 56 of the first flange 22 form a continuous edge 73, the second flange 24 has an inner edge 38, an outer edge 59, a top edge 60 and a bottom edge 61, the inner edge 58 of the second reinforcing member 36 and the bottom edge 61 of the second flange 24 form a continuous edge 74, the third flange 26 has an inner edge 63, an outer edge 64, a top edge 65 and a bottom edge 66, the inner edge 41 of the third reinforcing member 39 and the bottom edge 66 of the third flange 26 form a continuous edge 75, the fourth flange 28 has an inner edge 68, an outer edge 69, a top edge 70 and a bottom edge 71, and the inner edge 44 of the fourth reinforcing member 42 and the bottom edge 71 of the fourth flange 28 form a continuous edge 76.

Figure 4:
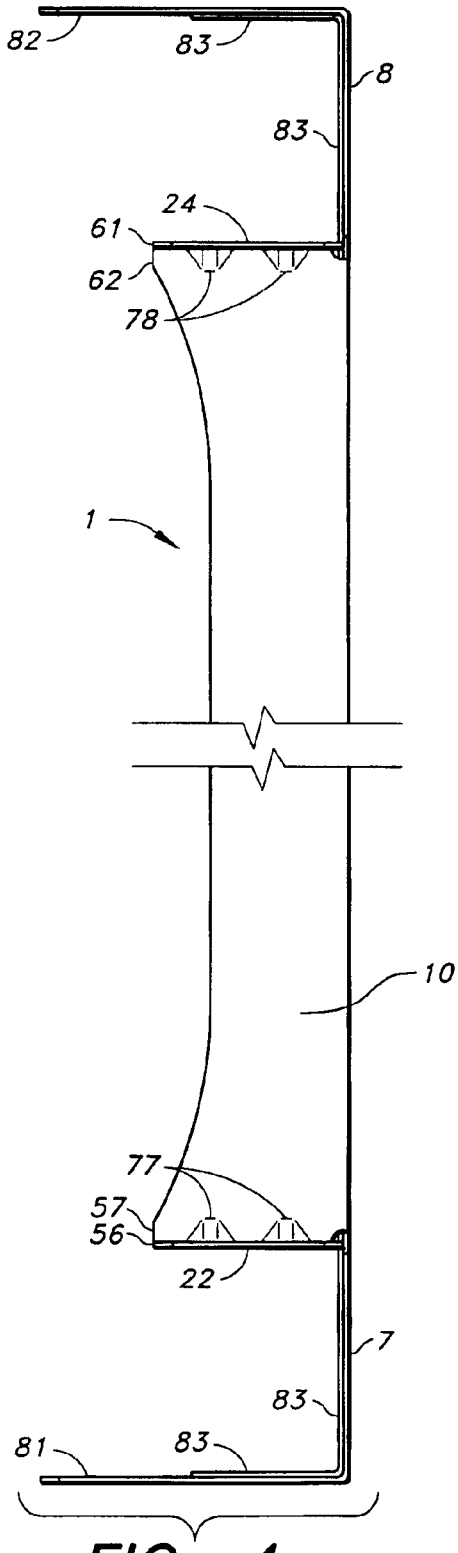
FIG. 4 is a side elevation view of the preferred embodiment of the apparatus of the present invention.

As best shown in FIGS. 4 and 5, the bottom edge 56 of the first flange 22 preferably meets the second longitudinal member 10 at a first junction 57, the inner edge 35 of the first reinforcing member 33 curves to the first junction 57, the bottom edge 61 of the second flange 24 meets the second longitudinal member 10 at a second junction 62, the inner edge 38 of the second reinforcing member 36 curves to meet the second junction 62, the bottom edge 66 of the third flange 26 meets the third longitudinal member 16 at a third junction 67, the inner edge 41 of the third reinforcing member 39 curves to meet the third junction 67, the bottom edge 71 of the fourth flange 28 meets the third longitudinal 16 member at a fourth junction 72, and the inner edge 44 of the fourth reinforcing member 42 curves to meet the fourth junction 72.

As best shown in FIG. 5, the first reinforcing member 33 and the second reinforcing member 36 preferably join to form a fourth longitudinal member 45, the inner edge 35 of the first reinforcing member 33 and the inner edge 38 of the second reinforcing member 36 joining to form a continuous inner edge 46 of the fourth longitudinal member 45, and the outer edge 34 of the first reinforcing member 33 and the outer edge 37 of the second reinforcing member 36 joining to form a continuous outer edge 47 that joins the second side 14 of the second longitudinal member 10 to form a third longitudinal juncture 48 and the third reinforcing member 39 and the fourth reinforcing member 42 join to form a fifth longitudinal member 49, the inner edge 41 of the third reinforcing member 39 and the inner edge 44 of the fourth reinforcing member 42 joining to form a continuous inner edge 50 of the fifth longitudinal member, and the outer edge 40 of the third reinforcing member 39 and the outer edge 43 of the fourth reinforcing member 42 joining to form a continuous outer edge 51 that joins the second side 20 of the third longitudinal member 16 to form a fourth longitudinal juncture 52.

As best shown in FIG. 1, FIG. 4 and FIG. 6, the apparatus 1 of the present invention preferably further comprises a first end attachment tab 81 joined to the first top attachment tab 7, and a second end attachment tab 82 joined to the second top attachment tab 8.

Figure 3:
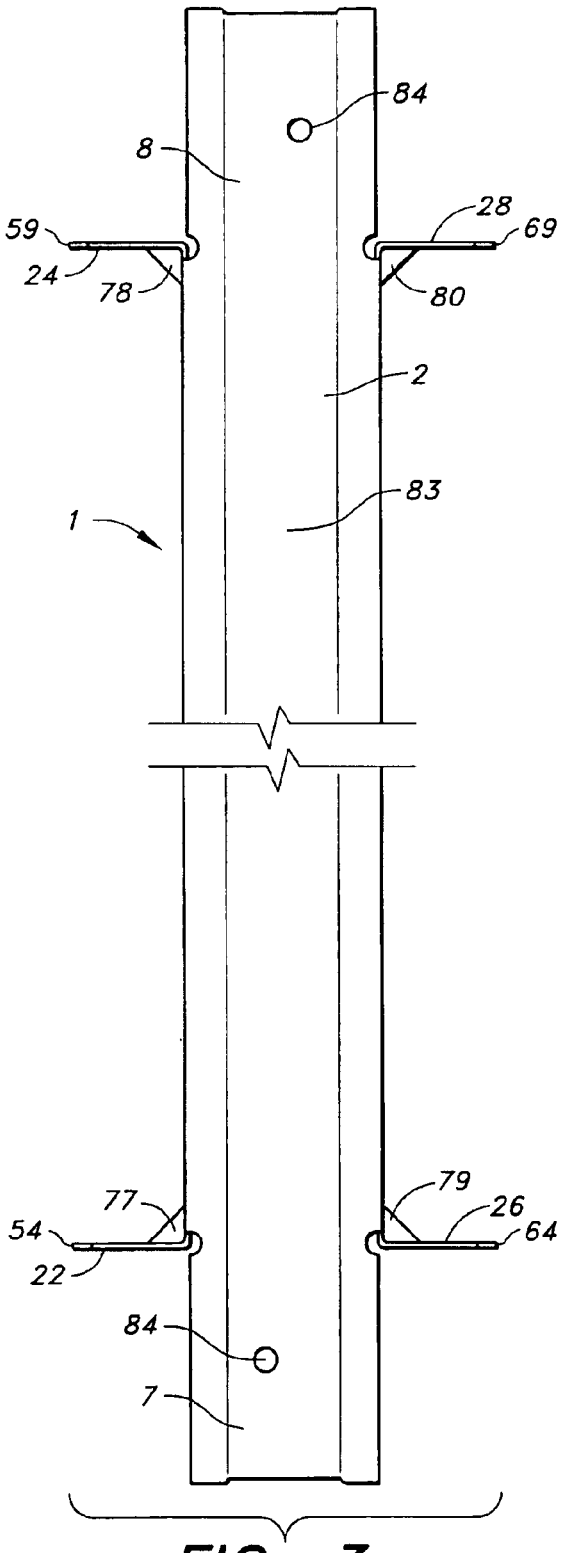
FIG. 3 is a top plan view of the preferred embodiment of the apparatus of the present invention.

As best shown in FIG. 1, FIG. 3 and FIG. 4, the apparatus 1 of the present invention preferably further comprises a continuous reinforcing embossment 83 in the first end attachment tab 81, the first top attachment tab 7, the first longitudinal member 2, the second top attachment tab 8 and the second end attachment tab 82.

As best shown in FIGS. 1, 3, 6 and 6A, the apparatus 1 of the present invention preferably further comprises fastener openings 84 in the first end attachment tab 81, the first top attachment tab 7, the second top attachment tab 8 and the end attachment tab 82.

Figure 2:
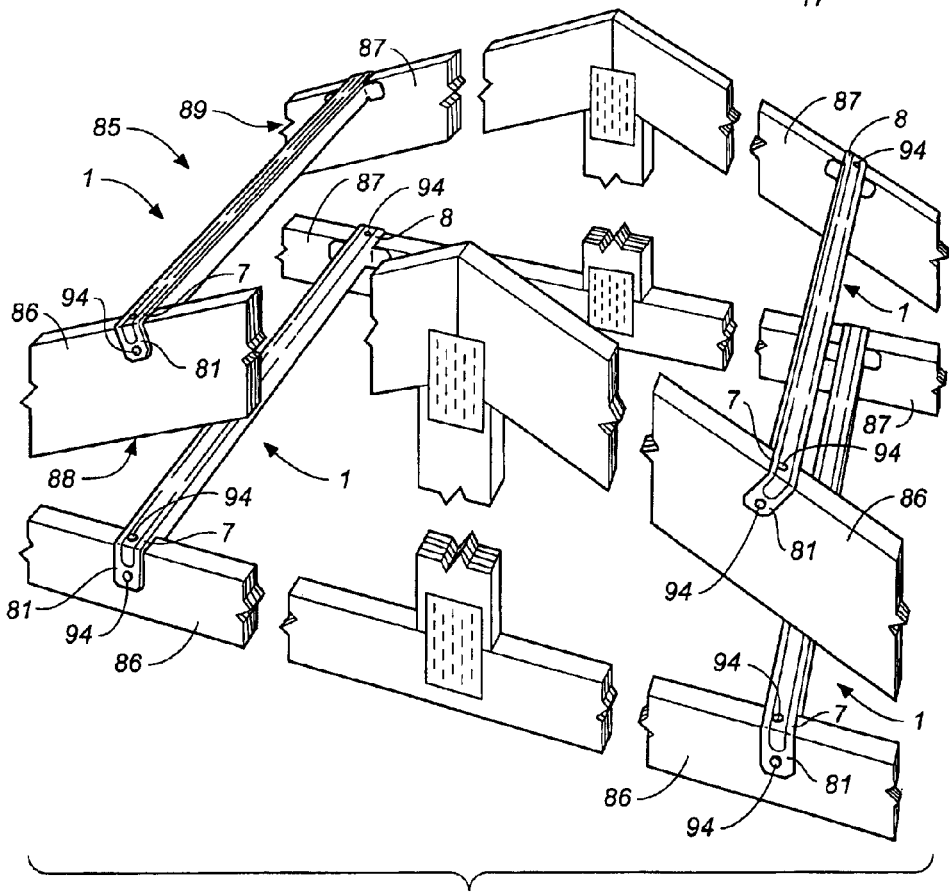
FIG. 2 is a perspective view showing two roof trusses connected by apparati of the present invention.

As best shown in FIG. 2, the apparatus 1 of the present invention preferably is in a connection 85 that further comprises fasteners 94, a first structural member 86 attached to the first end attachment tab 81 and the first top attachment tab 7 with the fasteners 94, and a second structural member 87 attached to the second end attachment tab 82 and the second top attachment tab 8 with the fasteners 94. The fasteners are preferably nails, but may also be brads, screws, bolts or integral teeth. Alternatively, the apparatus 1 of the present invention may be attached to the first structural member 86 and the second structural member 87 with tack welds or adhesives.

As shown in FIG. 2, the first structural member 86 is preferably part of a first roof truss 88, and the second structural member 87 is part of a second roof truss 89.

As best shown in FIG. 7, FIG. 8, FIG. 9 and FIG. 10, when the connected structural members are made of wood, the flanges 22, 24, 26 and 28 eventually bend back under compression loads and the junctures 21, 23, 25 and 27 are driven into the sides of the structural members 86 and 87. The gusset darts 77, 78, 79, and 80 prevent movement along the junctures 21, 23, 25 and 27 and the connection is changed from one with two pin joints to a columnar connection that resists rotation at the interfaces of the apparatus 1 and the structural members 86 and 87. This allows greater compression loads to be resisted.

In a first alternate preferred embodiment, the present invention is preferably an apparatus 1 that comprises a first longitudinal member 2 having a first end 3, a second end 4, a first side 5 and a second side 6, a first top attachment tab 7 joined to the first end 3 and a second top attachment tab 8 joined to the second end 4, a first longitudinal juncture 9 along the first side 5 of the first longitudinal member 2, a second longitudinal member 10, having a first end 11, a second end 12, a first side 13 and a second side 14, joined to the first longitudinal member 2 at the first longitudinal juncture 9, a second longitudinal juncture 15 along the second side 6 of the first longitudinal member 2, and a third longitudinal member 16, having a first end 17, a second end 18, a first side 19 and a second side 20, joined to the first longitudinal member 2 at the second longitudinal juncture 15. This embodiment preferably further comprises a first end juncture 21 along the first end 11 of the second longitudinal member 10, a first flange 22 joined to the second longitudinal 10 member at the first end juncture 21, a second end juncture 23 along the second end 12 of the second longitudinal member 10, a second flange 24 joined to the second longitudinal member 10 at the second end juncture 23, a third end juncture 25 along the first end 17 of the third longitudinal member 16, a third flange 26 joined to the third longitudinal member 16 at the third end juncture 25, a fourth end juncture 27 along the second end 18 of the third longitudinal member 16, and a fourth flange 28 joined to the third longitudinal member 16 at the fourth end juncture 27. This embodiment preferably further comprises a first portion 29 turned out of the second longitudinal member 10 at the first end 11 of the second longitudinal member 10 and reinforcing the first end 11 of the second longitudinal member 10, a second portion 30 turned out of the second longitudinal member 10 at the second end 12 of the second longitudinal member and reinforcing the second end 12 of the second longitudinal member 10, a third portion 31 turned out of the third longitudinal member 16 at the first end 17 of the third longitudinal member 16 and reinforcing the first end 17 of the third longitudinal member 16, and a fourth portion 32 turned out of the second longitudinal member 10 at the second end 18 of the third longitudinal member 16 and reinforcing the second end 18 of the third longitudinal member 16. The first portion 29 preferably is a first reinforcing member 33 with an outer edge 34 along part of the second side 14 of the second longitudinal member 10 and an inner edge 35 that terminates at the first end 11 of the second longitudinal member 10, the second portion 30 is a second reinforcing member 36 with an outer edge 37 along part of the second side 11 of the second longitudinal member 10 and an inner edge 38 that terminates at the second end 12 of the second longitudinal member 10, the third portion 31 is a third reinforcing member 39 with an outer edge 40 along part of the second side 20 of the third longitudinal member 16 and an inner edge 41 that terminates at the first end 17 of the third longitudinal member 16, the fourth portion 32 is a fourth reinforcing member 42 with an outer edge 43 along part of the second side 20 of the third longitudinal member 16 and an inner edge 44 that terminates at the second end 18 of the third longitudinal member 16. The first reinforcing member 33 and the second reinforcing member 36 preferably join to form a fourth longitudinal member 45, the inner edge 35 of the first reinforcing member 33 and the inner edge 38 of the second reinforcing member 36 joining to form a continuous inner edge 46 of the fourth longitudinal member 45, and the outer edge 34 of the first reinforcing member 33 and the outer edge 37 of the second reinforcing member 36 joining to form a continuous outer edge 47 that joins the second side 14 of the second longitudinal member 10 to form a third longitudinal juncture 48, and the third reinforcing member 39 and the fourth reinforcing member 42 join to form a fifth longitudinal member 49, the inner edge 41 of the third reinforcing member 39 and the inner edge 44 of the fourth reinforcing member 42 joining to form a continuous inner edge 50 of the fifth longitudinal member 49, and the outer edge 40 of the third reinforcing member 39 and the outer edge 43 of the fourth reinforcing member 42 joining to form a continuous outer edge 51 that joins the second side 20 of the third longitudinal member 16 to form a fourth longitudinal juncture 52.

In a second alternate preferred embodiment, the present invention is preferably an apparatus 1 that comprises a first longitudinal member 2 having a first end 3, a second end 4, a first side 5 and a second side 6, a first top attachment tab 7 joined to the first end 3 and a second top attachment tab 8 joined to the second end 4, a first longitudinal juncture 9 along the first side 5 of the first longitudinal member 2, a second longitudinal member 10, having a first end 11, a second end 12, a first side 13 and a second side 14, joined to the first longitudinal member 2 at the first longitudinal juncture 9, a second longitudinal juncture 15 along the second side 6 of the first longitudinal member 2, and a third longitudinal member 16, having a first end 17, a second end 18, a first side 19 and a second side 20, joined to the first longitudinal member 2 at the second longitudinal juncture 15. This embodiment preferably further comprises a first end juncture 21 along the first end 11 of the second longitudinal member 10, a first flange 22 joined to the second longitudinal 10 member at the first end juncture 21, a second end juncture 23 along the second end 12 of the second longitudinal member 10, a second flange 24 joined to the second longitudinal member 10 at the second end juncture 23, a third end juncture 25 along the first end 17 of the third longitudinal member 16, a third flange 26 joined to the third longitudinal member 16 at the third end juncture 25, a fourth end juncture 27 along the second end 18 of the third longitudinal member 16, and a fourth flange 28 joined to the third longitudinal member 16 at the fourth end juncture 27. This embodiment preferably further comprises a first portion 29 turned out of the second longitudinal member 10 at the first end 11 of the second longitudinal member 10 and reinforcing the first end 11 of the second longitudinal member 10, a second portion 30 turned out of the second longitudinal member 10 at the second end 12 of the second longitudinal member 10 and reinforcing the second end 12 of the second longitudinal member 10, a third portion 31 turned out of the third longitudinal member 16 at the first end 17 of the third longitudinal member 16 and reinforcing the first end 17 of the third longitudinal member 16, and a fourth portion 32 turned out of the second longitudinal member 10 at the second end 18 of the third longitudinal member 16 and reinforcing the second end 18 of the third longitudinal member 16. The first portion 29 preferably is a first reinforcing member 33 with an outer edge 34 along part of the second side 14 of the second longitudinal member 10 and an inner edge 35 that terminates at the first end 11 of the second longitudinal member 10, the second portion 30 is a second reinforcing member 36 with an outer edge 37 along part of the second side 11 of the second longitudinal member 10 and an inner edge 38 that terminates at the second end 12 of the second longitudinal member 10, the third portion 31 is a third reinforcing member 39 with an outer edge 40 along part of the second side 20 of the third longitudinal member 16 and an inner edge 41 that terminates at the first end 17 of the third longitudinal member 16, the fourth portion 32 is a fourth reinforcing member 42 with an outer edge 43 along part of the second side 20 of the third longitudinal member 16 and an inner edge 44 that terminates at the second end 18 of the third longitudinal member 16. The first flange 22 preferably has an inner edge 53, an outer edge 54, a top edge 55 and a bottom edge 56, the bottom edge 56 meeting the second longitudinal member 10 at a first junction 57; the inner edge 35 of the first reinforcing member 33 curves to the first junction 57, the second flange 24 has an inner edge 58, an outer edge 59, a top edge 60 and a bottom edge 61, the bottom edge 61 meeting the second longitudinal member 10 at a second junction 62, the inner edge 38 of the second reinforcing member 36 curves to meet the second junction 62, the third flange 26 has an inner edge 63, an outer edge 64, a top edge 65 and a bottom edge 66, the bottom edge 66 meeting the third longitudinal member 16 at a third junction 67, the inner edge 41 of the third reinforcing member 39 curves to meet the third junction 67, the fourth flange 28 has an inner edge 68, an outer edge 69, a top edge 70 and a bottom edge 71, the bottom edge 71 meeting the third longitudinal member 16 at a fourth junction 72, and the inner edge 44 of the fourth reinforcing member 42 curves to meet the fourth junction 72.

In a third alternate preferred embodiment, the present invention is preferably an apparatus 1 that comprises a first longitudinal member 2 having a first end 3, a second end 4, a first side 5 and a second side 6, a first top attachment tab 7 joined to the first end 3 and a second top attachment tab 8 joined to the second end 4, a first longitudinal juncture 9 along the first side 5 of the first longitudinal member 2, a second longitudinal member 10, having a first end 11, a second end 12, a first side 13 and a second side 14, joined to the first longitudinal member 2 at the first longitudinal juncture 9, a second longitudinal juncture 15 along the second side 6 of the first longitudinal member 2, and a third longitudinal member 16, having a first end 17, a second end 18, a first side 19 and a second side 20, joined to the first longitudinal member 2 at the second longitudinal juncture 15. This embodiment preferably further comprises a first end juncture 21 along the first end 11 of the second longitudinal member 10, a first flange 22 joined to the second longitudinal 10 member at the first end juncture 21, a second end juncture 23 along the second end 12 of the second longitudinal member 10, a second flange 24 joined to the second longitudinal member 10 at the second end juncture 23, a third end juncture 25 along the first end 17 of the third longitudinal member 16, a third flange 26 joined to the third longitudinal member 16 at the third end juncture 25, a fourth end juncture 27 along the second end 18 of the third longitudinal member 16, and a fourth flange 28 joined to the third longitudinal member 16 at the fourth end juncture 27. This embodiment preferably further comprises a first portion 29 turned out of the second longitudinal member 10 at the first end 11 of the second longitudinal member 10 and reinforcing the first end 11 of the second longitudinal member 10, a second portion 30 turned out of the second longitudinal member 10 at the second end 12 of the second longitudinal member 10 and reinforcing the second end 12 of the second longitudinal member 10, a third portion 31 turned out of the third longitudinal member 16 at the first end 17 of the third longitudinal member 16 and reinforcing the first end 17 of the third longitudinal member 16, and a fourth portion 32 turned out of the second longitudinal member 10 at the second end 18 of the third longitudinal member 16 and reinforcing the second end 18 of the third longitudinal member 16. The first portion 29 preferably is a first reinforcing member 33 with an outer edge 34 along part of the second side 14 of the second longitudinal member 10 and an inner edge 35 that terminates at the first end 11 of the second longitudinal member 10, the second portion 30 is a second reinforcing member 36 with an outer edge 37 along part of the second side 11 of the second longitudinal member 10 and an inner edge 38 that terminates at the second end 12 of the second longitudinal member 10, the third portion 31 is a third reinforcing member 39 with an outer edge 40 along part of the second side 20 of the third longitudinal member 16 and an inner edge 41 that terminates at the first end 17 of the third longitudinal member 16, the fourth portion 32 is a fourth reinforcing member 42 with an outer edge 43 along part of the second side 20 of the third longitudinal member 16 and an inner edge 44 that terminates at the second end 18 of the third longitudinal member 16. The first flange 22 preferably has an inner edge 53, an outer edge 54, a top edge 55 and a bottom edge 56, the inner edge 35 of the first reinforcing member 33 and the bottom edge 56 of the first flange 22 form a continuous edge 73, the second flange 24 has an inner edge 58, an outer edge 59, a top edge 60 and a bottom edge 61, the inner edge 58 of the second reinforcing member 36 and the bottom edge 61 of the second flange 24 form a continuous edge 74, the third flange 26 has an inner edge 63, an outer edge 64, a top edge 65 and a bottom edge 66, the inner edge 63 of the third reinforcing member 39 and the bottom edge 66 of the third flange 26 form a continuous edge 75, the fourth flange 28 has an inner edge 68, an outer edge 69, a top edge 70 and a bottom edge 71, and the inner edge 68 of the fourth reinforcing member 42 and the bottom edge 71 of the fourth flange 28 form a continuous edge 76.

In a fourth alternate preferred embodiment, the present invention is preferably an apparatus 1 that comprises a first longitudinal member 2 having a first end 3, a second end 4, a first side 5 and a second side 6, a first top attachment tab 7 joined to the first end 3 and a second top attachment tab 8 joined to the second end 4, a first longitudinal juncture 9 along the first side 5 of the first longitudinal member 2, a second longitudinal member 10, having a first end 11, a second end 12, a first side 13 and a second side 14, joined to the first longitudinal member 2 at the first longitudinal juncture 9, a second longitudinal juncture 15 along the second side 6 of the first longitudinal member 2, and a third longitudinal member 16, having a first end 17, a second end 18, a first side 19 and a second side 20, joined to the first longitudinal member 2 at the second longitudinal juncture 15. This embodiment preferably further comprises a first end juncture 21 along the first end 11 of the second longitudinal member 10, a first flange 22 joined to the second longitudinal 10 member at the first end juncture 21, a second end juncture 23 along the second end 12 of the second longitudinal member 10, a second flange 24 joined to the second longitudinal member 10 at the second end juncture 23, a third end juncture 25 along the first end 17 of the third longitudinal member 16, a third flange 26 joined to the third longitudinal member 16 at the third end juncture 25, a fourth end juncture 27 along the second end 18 of the third longitudinal member 16, and a fourth flange 28 joined to the third longitudinal member 16 at the fourth end juncture 27. This embodiment preferably further comprises a first portion 29 turned out of the second longitudinal member 10 at the first end 11 of the second longitudinal member 10 and reinforcing the first end 11 of the second longitudinal member 10, a second portion 30 turned out of the second longitudinal member 10 at the second end 12 of the second longitudinal member 10 and reinforcing the second end 12 of the second longitudinal member 10, a third portion 31 turned out of the third longitudinal member 16 at the first end 17 of the third longitudinal member 16 and reinforcing the first end 17 of the third longitudinal member 16, and a fourth portion 32 turned out of the second longitudinal member 10 at the second end 18 of the third longitudinal member 16 and reinforcing the second end 18 of the third longitudinal member 16. The first portion 29 preferably is a first reinforcing member 33 with an outer edge 34 along part of the second side 14 of the second longitudinal member 10 and an inner edge 35 that terminates at the first end 11 of the second longitudinal member 10, the second portion 30 is a second reinforcing member 36 with an outer edge 37 along part of the second side 11 of the second longitudinal member 10 and an inner edge 38 that terminates at the second end 12 of the second longitudinal member 10, the third portion 31 is a third reinforcing member 39 with an outer edge 40 along part of the second side 20 of the third longitudinal member 16 and an inner edge 41 that terminates at the first end 17 of the third longitudinal member 16, the fourth portion 32 is a fourth reinforcing member 42 with an outer edge 43 along part of the second side 20 of the third longitudinal member 16 and an inner edge 44 that terminates at the second end 18 of the third longitudinal member 16. The first portion 29 preferably further comprises one or more gusset darts 77 in the first end juncture 21, the second portion 30 further comprises one or more gusset darts 78 in the second end juncture 23, the third portion 31 further comprises one or more gusset darts 79 in the third end juncture 25, and the fourth portion 32 further comprises one or more gusset darts 80 in the fourth end juncture 27. The first flange 22 preferably has an inner edge 53, an outer edge 54, a top edge 55 and a bottom edge 56, the bottom edge 56 meeting the second longitudinal member 10 at a first junction 57; the inner edge 35 of the first reinforcing member 33 curves to the first junction 57, the second flange 24 has an inner edge 58, an outer edge 59, a top edge 60 and a bottom edge 61, the bottom edge 61 meeting the second longitudinal member 10 at a second junction 62, the inner edge 38 of the second reinforcing member 36 curves to meet the second junction 62, the third flange 26 has an inner edge 63, an outer edge 64, a top edge 65 and a bottom edge 66, the bottom edge 66 meeting the third longitudinal member 16 at a third junction 67, the inner edge 41 of the third reinforcing member 39 curves to meet the third junction 67, the fourth flange 28 has an inner edge 68, an outer edge 69, a top edge 70 and a bottom edge 71, the bottom edge 71 meeting the third longitudinal member 16 at a fourth junction 72, and the inner edge 44 of the fourth reinforcing member 42 curves to meet the fourth junction 72.

In a fifth alternate preferred embodiment, the present invention is preferably an apparatus 1 that comprises a first longitudinal member 2 having a first end 3, a second end 4, a first side 5 and a second side 6, a first top attachment tab 7 joined to the first end 3 and a second top attachment tab 8 joined to the second end 4, a first longitudinal juncture 9 along the first side 5 of the first longitudinal member 2, a second longitudinal member 10, having a first end 11, a second end 12, a first side 13 and a second side 14, joined to the first longitudinal member 2 at the first longitudinal juncture 9, a second longitudinal juncture 15 along the second side 6 of the first longitudinal member 2, and a third longitudinal member 16, having a first end 17, a second end 18, a first side 19 and a second side 20, joined to the first longitudinal member 2 at the second longitudinal juncture 15. This embodiment preferably further comprises a first end juncture 21 along the first end 11 of the second longitudinal member 10, a first flange 22 joined to the second longitudinal 10 member at the first end juncture 21, a second end juncture 23 along the second end 12 of the second longitudinal member 10, a second flange 24 joined to the second longitudinal member 10 at the second end juncture 23, a third end juncture 25 along the first end 17 of the third longitudinal member 16, a third flange 26 joined to the third longitudinal member 16 at the third end juncture 25, a fourth end juncture 27 along the second end 18 of the third longitudinal member 16, and a fourth flange 28 joined to the third longitudinal member 16 at the fourth end juncture 27. This embodiment preferably further comprises a first portion 29 turned out of the second longitudinal member 10 at the first end 11 of the second longitudinal member 10 and reinforcing the first end 11 of the second longitudinal member 10, a second portion 30 turned out of the second longitudinal member 10 at the second end 12 of the second longitudinal member 10 and reinforcing the second end 12 of the second longitudinal member 10, a third portion 31 turned out of the third longitudinal member 16 at the first end 17 of the third longitudinal member 16 and reinforcing the first end 17 of the third longitudinal member 16, and a fourth portion 32 turned out of the second longitudinal member 10 at the second end 18 of the third longitudinal member 16 and reinforcing the second end 18 of the third longitudinal member 16. The first portion 29 preferably is one or more gusset darts 77 in the first end juncture 21, the second portion 30 is one or more gusset darts 78 in the second end juncture 23, the third portion 31 is one or more gusset darts 79 in the third end juncture 25, and the fourth portion 32 is one or more gusset darts 80 in the fourth end juncture 27.

Figure 5B:
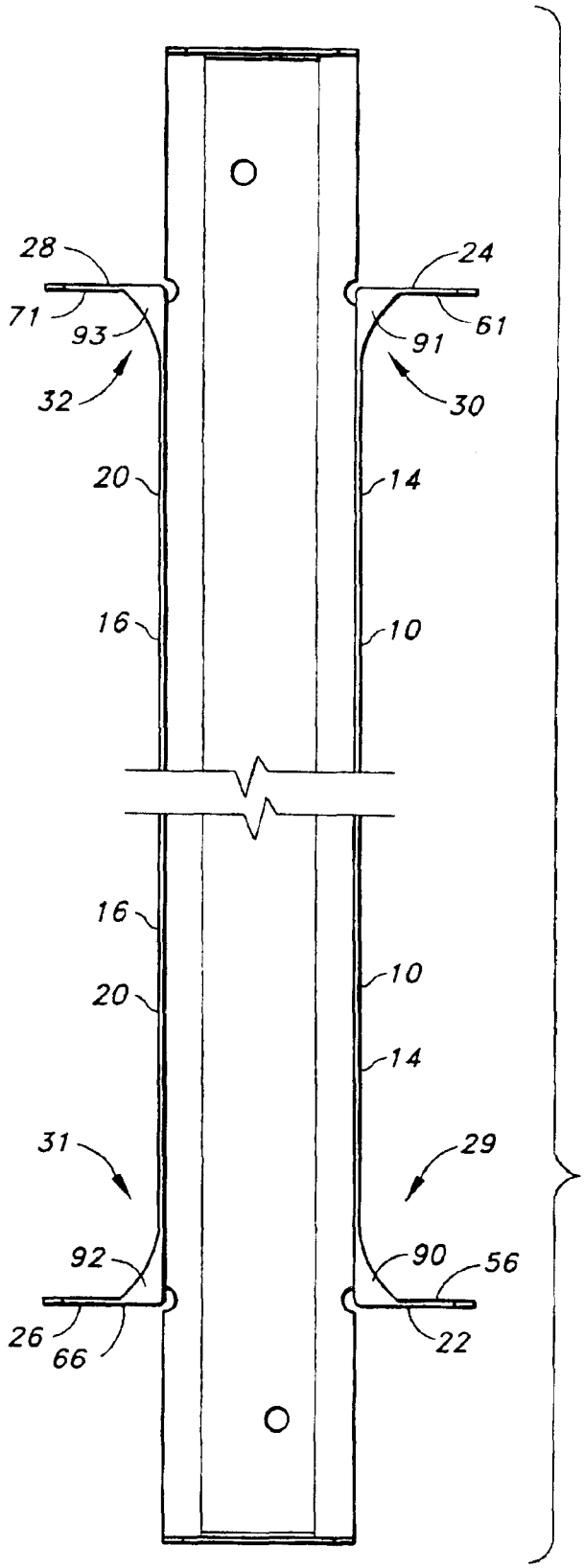
FIG. 5B is a bottom plan view of an alternate preferred embodiment of the apparatus of the present invention.
Figure 5C:
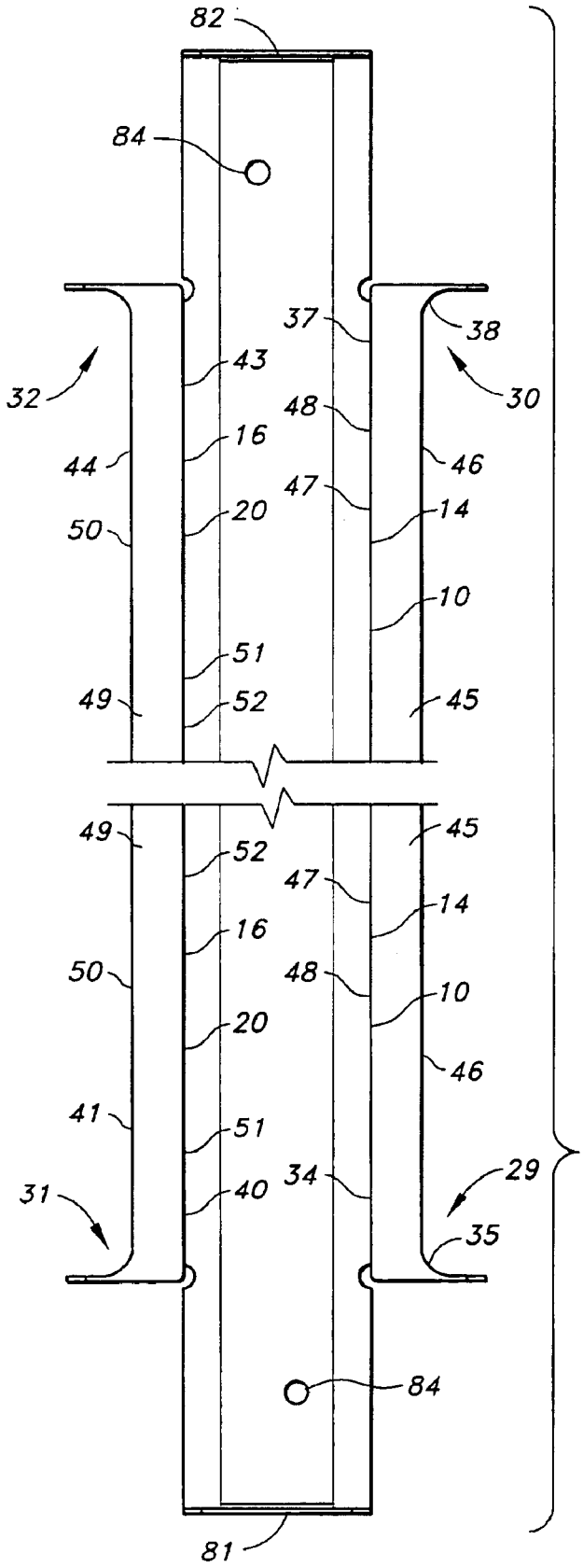
FIG. 5C is a bottom plan view of an alternate preferred embodiment of the apparatus of the present invention.
Figure 7:
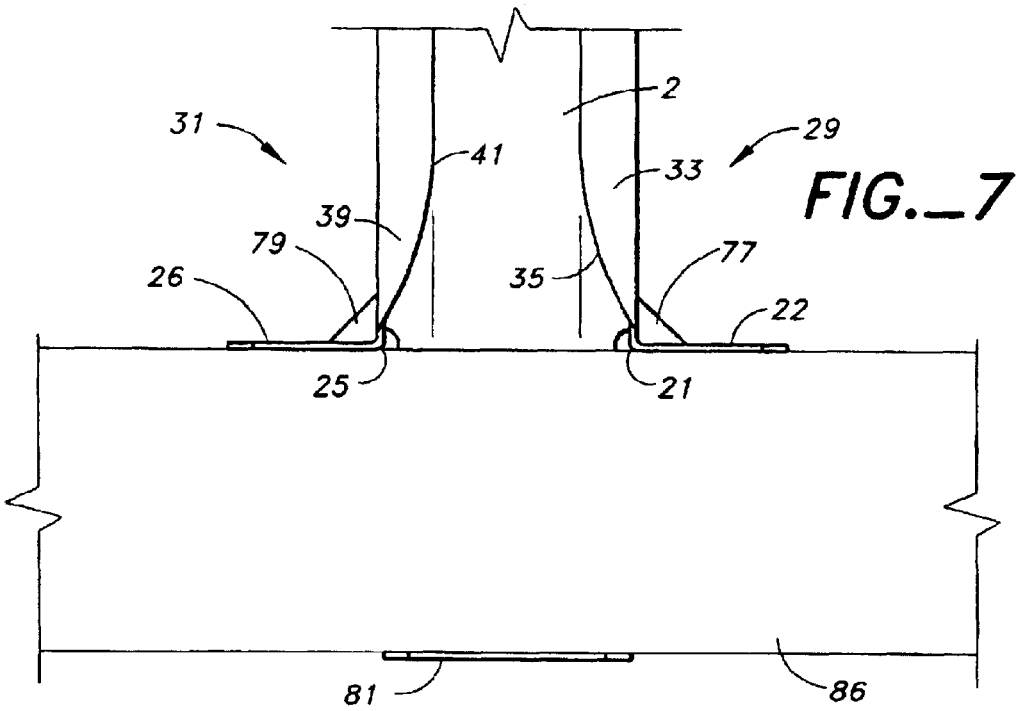
FIG. 7 is a bottom plan view showing one end of the preferred embodiment of the apparatus of the present invention connected to a structural member.
Figure 8:
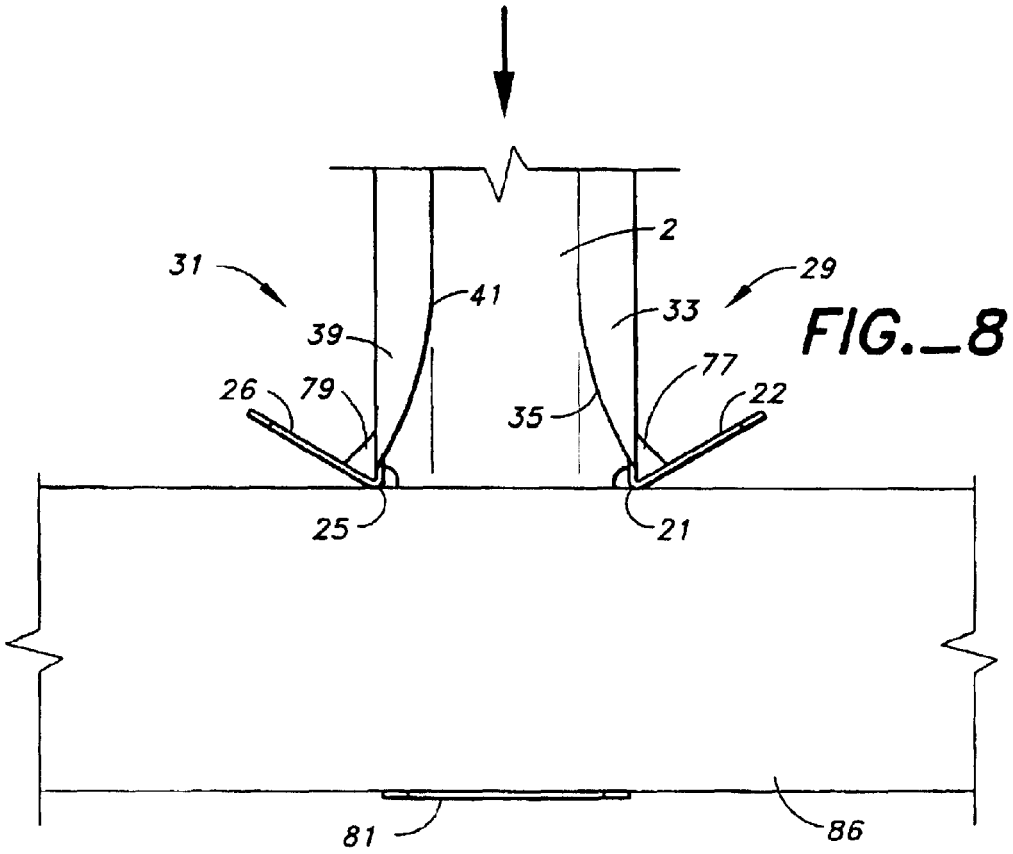
FIG. 8 is a bottom plan view showing one end of the preferred embodiment of the apparatus of the present invention connected to a structural member, further showing a compression load being applied and the flanges beginning to fold back.
Figure 9:
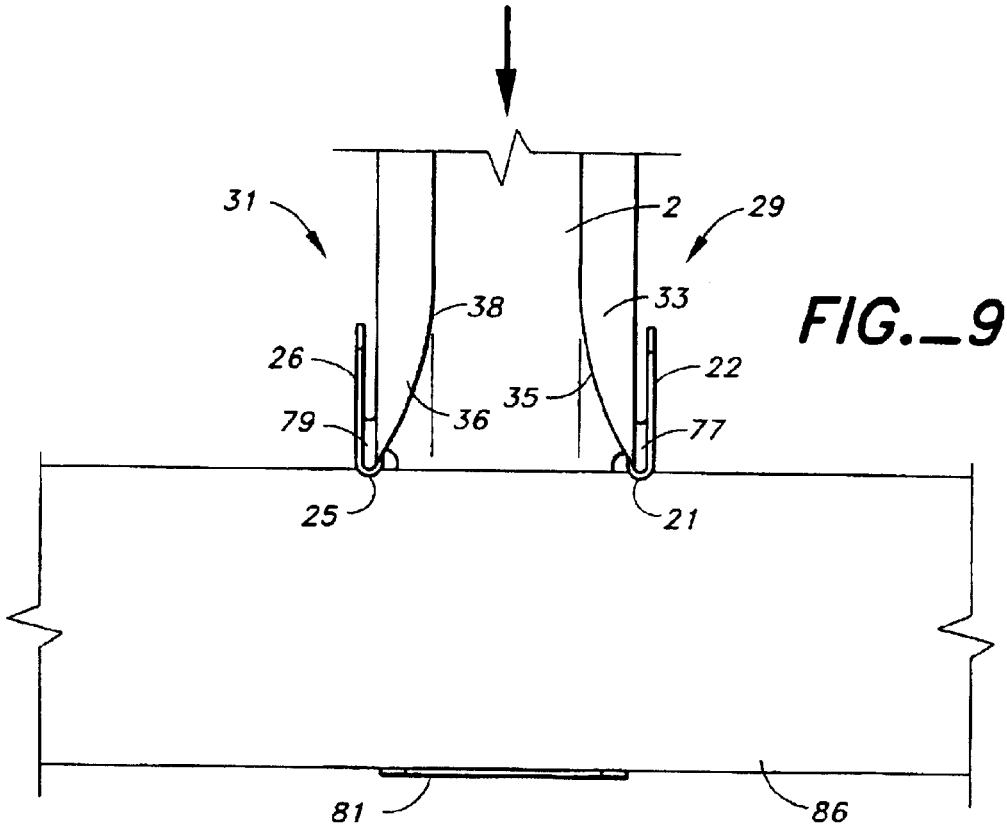
FIG. 9 is a bottom plan view showing one end of the preferred embodiment of the apparatus of the present invention connected to a structural member, further showing a compression load being applied and the flanges folded back and the junctures with the second and third longitudinal members beginning to embed in the wood of the connected structural members.
Figure 10:
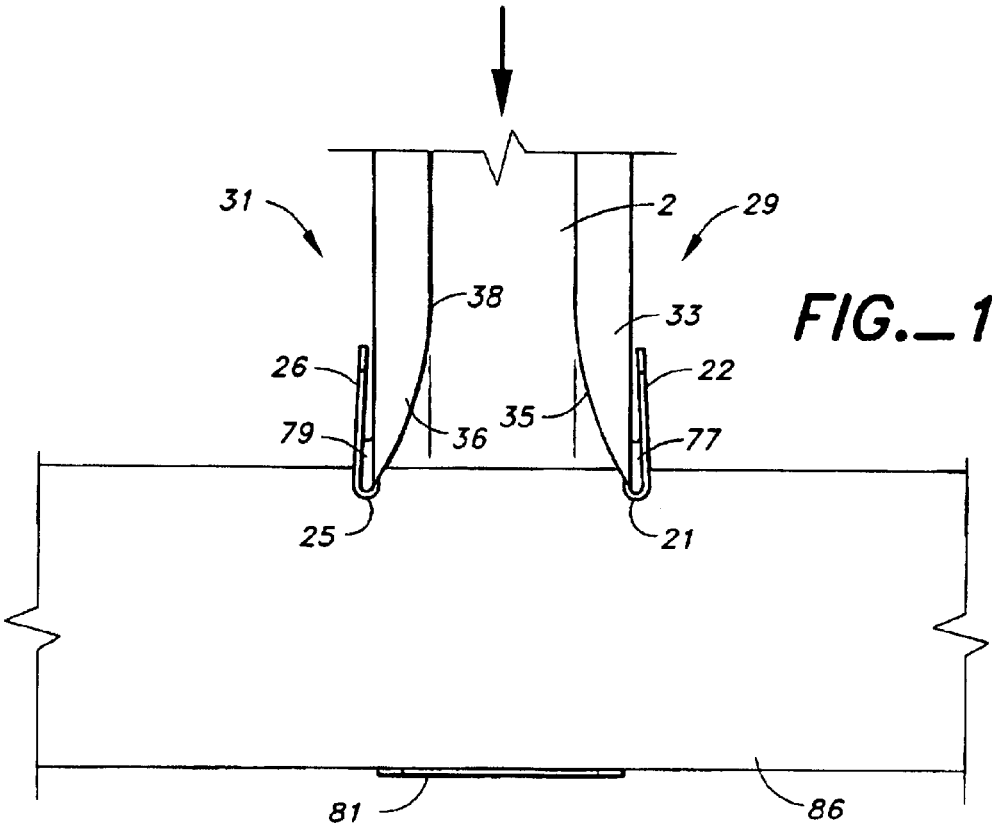
FIG. 10 is a bottom plan view showing one end of the preferred embodiment of the apparatus of the present invention connected to a structural member, further showing a compression load being applied and the flanges folded back and the junctures with the second and third longitudinal members embedded in the wood of the connected structural members.

In a sixth alternate preferred embodiment, the present invention is preferably an apparatus 1 that comprises a first longitudinal member 2 having a first end 3, a second end 4, a first side 5 and a second side 6, a first top attachment tab 7 joined to the first end 3 and a second top attachment tab 8 joined to the second end 4, a first longitudinal juncture 9 along the first side 5 of the first longitudinal member 2, a second longitudinal member 10, having a first end 11, a second end 12, a first side 13 and a second side 14, joined to the first longitudinal member 2 at the first longitudinal juncture 9, a second longitudinal juncture 15 along the second side 6 of the first longitudinal member 2, and a third longitudinal member 16, having a first end 17, a second end 18, a first side 19 and a second side 20, joined to the first longitudinal member 2 at the second longitudinal juncture 15. This embodiment preferably further comprises a first end juncture 21 along the first end 11 of the second longitudinal member 10, a first flange 22 joined to the second longitudinal 10 member at the first end juncture 21, a second end juncture 23 along the second end 12 of the second longitudinal member 10, a second flange 24 joined to the second longitudinal member 10 at the second end juncture 23, a third end juncture 25 along the first end 17 of the third longitudinal member 16, a third flange 26 joined to the third longitudinal member 16 at the third end juncture 25, a fourth end juncture 27 along the second end 18 of the third longitudinal member 16, and a fourth flange 28 joined to the third longitudinal member 16 at the fourth end juncture 27. This embodiment preferably further comprises a first portion 29 turned out of the second longitudinal member 10 at the first end 11 of the second longitudinal member 10 and reinforcing the first end 11 of the second longitudinal member 10, a second portion 30 turned out of the second longitudinal member 10 at the second end 12 of the second longitudinal member 10 and reinforcing the second end 12 of the second longitudinal member 10, a third portion 31 turned out of the third longitudinal member 16 at the first end 17 of the third longitudinal member 16 and reinforcing the first end 17 of the third longitudinal member 16, and a fourth portion 32 turned out of the second longitudinal member 10 at the second end 18 of the third longitudinal member 16 and reinforcing the second end 18 of the third longitudinal member 16. As best shown in FIG. 5B, the first flange 22 preferably has an inner edge 53, an outer edge 54, a top edge 55 and a bottom edge 56, the first portion 29 is a first gusset 90 that connects part of the bottom edge 56 of the first flange 22 to part of the second side 14 of the second longitudinal member 10, the second flange 24 has an inner edge 58, an outer edge 59, a top edge 60 and a bottom edge 61, the second portion 30 is a second gusset 91 that connects part of the bottom edge 61 of the second flange 24 to part of the second side 14 of the second longitudinal member 10, the third flange 26 has an inner edge 63, an outer edge 64, a top edge 65 and a bottom edge 66, the third portion 31 is a third gusset 92 that connects part of the bottom edge 66 of the third flange 26 to part of the second side 20 of the third longitudinal member 16, the fourth flange 28 has an inner edge 68, an outer edge 69, a top edge 70 and a bottom edge 71, and the fourth portion 32 is a fourth gusset 93 that connects part of the bottom edge 71 of the fourth flange 28 to part of the second side 20 of the third longitudinal member 16. As best shown in FIG. 5C, the first portion 29 and the second portion 30 preferably join to form a fourth longitudinal member 45, the inner edge 35 of the first portion 29 and the inner edge 38 of the second portion 30 joining to form a continuous inner edge 46 of the fourth longitudinal member 45, and the outer edge 34 of the first portion 29 and the outer edge 37 of the second portion 30 joining to form a continuous outer edge 47 that joins the second side 14 of the second longitudinal member 10 to form a third longitudinal juncture 48, and the third portion 31 and the fourth portion 32 join to form a fifth longitudinal member 49, the inner edge 41 of the third portion 31 and the inner edge 44 of the fourth portion 32 joining to form a continuous inner edge 50 of the fifth longitudinal member 49, and the outer edge 40 of the third portion 31 and the outer edge 43 of the fourth portion 32 joining to form a continuous outer edge 51 that joins the second side 20 of the third longitudinal member 16 to form a fourth longitudinal juncture 52.

We claim:

1. An apparatus comprising:

a. a first longitudinal member having a first end, a second end, a first side and a second side;

b. a first top attachment tab joined to said first end and a second top attachment tab joined to said second end;

c. a first longitudinal juncture along said first side of said first longitudinal member;

d. a second longitudinal member, having a first end, a second end, a first side and a second side, joined to said first longitudinal member at said first longitudinal juncture;

e. a second longitudinal juncture along said second side of said first longitudinal member;

f. a third longitudinal member, having a first end, a second end, a first side and a second side, joined to said first longitudinal member at said second longitudinal juncture;

g. a first end juncture along said first end of said second longitudinal member;

h. a first flange joined to said second longitudinal member at said first end juncture;

i. a second end juncture along said second end of said second longitudinal member;

j. a second flange joined to said second longitudinal member at said second end juncture;

k. a third end juncture along said first end of said third longitudinal member;

l. a third flange joined to said third longitudinal member at said third end juncture;

m. a fourth end juncture along said second end of said third longitudinal member;

n. a fourth flange joined to said third longitudinal member at said fourth end juncture;

o. a first portion, distinct from said first flange, turned out of said second longitudinal member at said first end of said second longitudinal member and reinforcing said first end of said second longitudinal member;

p. a second portion, distinct from said second flange, turned out of said second longitudinal member at said second end of said second longitudinal member and reinforcing said second end of said second longitudinal member;

q. a third portion, distinct from said third flange, turned out of said third longitudinal member at said first end of said third longitudinal member and reinforcing said first end of said third longitudinal member;

r. a fourth portion, distinct from said fourth flange, turned out of said third longitudinal member at said second end of said third longitudinal member and reinforcing said second end of said third longitudinal member; wherein:

i. said first portion comprises a first reinforcing member with an outer edge along part of said second side of said second longitudinal member and an inner edge, said inner edge being disposed at least partially opposite said outer edge across said first reinforcing member, said inner edge converging toward said outer edge and to said first end juncture such that said inner edge and said outer edge converge at an acute angle;

ii. said second portion comprises a second reinforcing member with an outer edge along part of said second side of said second longitudinal member and an inner edge, said inner edge being disposed at least partially opposite said outer edge across said first reinforcing member, said inner edge converging toward said outer edge and to said second end juncture such that said inner edge and said outer edge converge at an acute angle;

iii. said third portion comprises a third reinforcing member with an outer edge along part of said second side of said third longitudinal member and an inner edge, said inner edge being disposed at least partially opposite said outer edge across said first reinforcing member, said inner edge converging toward said outer edge and to said third end juncture such that said inner edge and said outer edge converge at an acute angle; and iv. said fourth portion is a fourth reinforcing member with an outer edge along part of said second side of said third longitudinal member and an inner edge, said inner edge being disposed at least partially opposite said outer edge across said first reinforcing member, said inner edge converging toward said outer edge and to said fourth end juncture such that said inner edge and said outer edge converge at an acute angle.

2. The apparatus of claim 1 wherein:

a. said first flange has an inner edge, an outer edge, a top edge and a bottom edge, said bottom edge meeting said second longitudinal member at a first junction;

b. said inner edge of said first reinforcing member curves to said first junction;

c. said second flange has an inner edge, an outer edge, a top edge and a bottom edge, said bottom edge meeting said second longitudinal member at a second junction;

d. said inner edge of said second reinforcing member curves to meet said second junction;

e. said third flange has an inner edge, an outer edge, a top edge and a bottom edge, said bottom edge meeting said third longitudinal member at a third junction;

f. said inner edge of said third reinforcing member curves to meet said third junction;

g. said fourth flange has an inner edge, an outer edge, a top edge and a bottom edge, said bottom edge meeting said third longitudinal member at a fourth junction; and h. said inner edge of said fourth reinforcing member curves to meet said fourth junction.

3. The apparatus of claim 1 wherein:

a. said first flange has an inner edge, an outer edge, a top edge and a bottom edge;

b. said inner edge of said first reinforcing member and said bottom edge of said first flange form a continuous edge;

c. said second flange has an inner edge, an outer edge, a top edge and a bottom edge;

d. said inner edge of said second reinforcing member and said bottom edge of said second flange form a continuous edge;

e. said third flange has an inner edge, an outer edge, a top edge and a bottom edge;

f. said inner edge of said third reinforcing member and said bottom edge of said third flange form a continuous edge;

g. said fourth flange has an inner edge, an outer edge, a top edge and a bottom edge; and h. said inner edge of said fourth reinforcing member and said bottom edge of said fourth flange form a continuous edge.

4. The apparatus of claim 1 wherein:

a. said first portion further comprises at least one gusset dart in said first end juncture;

b. said second portion further comprises at least one gusset dart in said second end juncture;

c. said third portion further comprises at least one gusset dart in said third end juncture; and d. said fourth portion further comprises at least one gusset dart in said fourth end juncture.

5. The apparatus of claim 4 wherein:

a. said first flange has an inner edge, an outer edge, a top edge and a bottom edge, said bottom edge meeting said second longitudinal member at a first junction;

b. said inner edge of said first reinforcing member curves to said first junction;

c. said second flange has an inner edge, an outer edge, a top edge and a bottom edge, said bottom edge meeting said second longitudinal member at a second junction;

d. said inner edge of said second reinforcing member curves to meet said second junction;

e. said third flange has an inner edge, an outer edge, a top edge and a bottom edge, said bottom edge meeting said third longitudinal member at a third junction;

f. said inner edge of said third reinforcing member curves to meet said third junction;

g. said fourth flange has an inner edge, an outer edge, a top edge and a bottom edge, said bottom edge meeting said third longitudinal member at a fourth junction; and h. said inner edge of said fourth reinforcing member curves to meet said fourth junction.

6. The apparatus of claim 4 wherein:

a. said first flange has an inner edge, an outer edge, a top edge and a bottom edge;

b. said inner edge of said first reinforcing member and said bottom edge of said first flange form a continuous edge;

c. said second flange has an inner edge, an outer edge, a top edge and a bottom edge;

d. said inner edge of said second reinforcing member and said bottom edge of said second flange form a continuous edge;

e. said third flange has an inner edge, an outer edge, a top edge and a bottom edge;

f. said inner edge of said third reinforcing member and said bottom edge of said third flange form a continuous edge;

g. said fourth flange has an inner edge, an outer edge, a top edge and a bottom edge; and h. said inner edge of said fourth reinforcing member and said bottom edge of said fourth flange form a continuous edge.

7. The apparatus of claim 6 wherein:

a. said bottom edge of said first flange meets said second longitudinal member at a first junction;

b. said inner edge of said first reinforcing member curves to said first junction;

c. said bottom edge of said second flange meets said second longitudinal member at a second junction;

d. said inner edge of said second reinforcing member curves to meet said second junction;

e. said bottom edge of said third flange meets said third longitudinal member at a third junction;

f. said inner edge of said third reinforcing member curves to meet said third junction;

g. said bottom edge of said fourth flange meets said third longitudinal member at a fourth junction; and h. said inner edge of said fourth reinforcing member curves to meet said fourth junction.

8. The apparatus of claim 7 wherein:

a. said first reinforcing member and said second reinforcing member join to form a fourth longitudinal member, said inner edge of said first reinforcing member and said inner edge of said second reinforcing member joining to form a continuous inner edge of said fourth longitudinal member, and said outer edge of said first reinforcing member and said outer edge of said second reinforcing member joining to form a continuous outer edge that joins said second side of said second longitudinal member to form a third longitudinal juncture; and b. said third reinforcing member and said fourth reinforcing member join to form a fifth longitudinal member, said inner edge of said third reinforcing member and said inner edge of said fourth reinforcing member joining to form a continuous inner edge of said fifth longitudinal member, and said outer edge of said third reinforcing member and said outer edge of said fourth reinforcing member joining to form a continuous outer edge that joins said second side of said third longitudinal member to form a fourth longitudinal juncture.

9. The apparatus of claim 8 further comprising:

a. a first end attachment tab joined to said first top attachment tab; and b. a second end attachment tab joined to said second top attachment tab.

10. The apparatus of claim 9 further comprising:

a. a continuous reinforcing embossment in said first end attachment tab, said first top attachment tab, said first longitudinal member, said second top attachment tab and said second end attachment tab.

11. The apparatus of claim 10 further comprising:

a. fastener openings in said first end attachment tab, said first top attachment tab, said second top attachment tab and said end attachment tab.

12. The apparatus of claim 11 further comprising, in combination:

a. fasteners;

a. a first structural member attached to said first end attachment tab and said first top attachment tab with said fasteners; and b. a second structural member attached to said second end attachment tab and said second top attachment tab with said fasteners.

13. The apparatus of claim 12 wherein:

a. said first structural member is part of a first roof truss; and b. said second structural member is part of a second roof truss.

14. The apparatus of claim 1 wherein:

a. said first flange has an inner edge, an outer edge, a top edge and a bottom edge;

b. said first portion is a first gusset that connects part of said bottom edge of said first flange to part of said second side of said second longitudinal member;

c. said second flange has an inner edge, an outer edge, a top edge and a bottom edge;

d. said second portion is a second gusset that connects part of said bottom edge of said second flange to part of said second side of said second longitudinal member;

e. said third flange has an inner edge, an outer edge, a top edge and a bottom edge;

f. said third portion is a third gusset that connects part of said bottom edge of said third flange to part of said second side of said third longitudinal member;

g. said fourth flange has an inner edge, an outer edge, a top edge and a bottom edge; and h. said fourth portion is a fourth gusset that connects part of said bottom edge of said fourth flange to part of said second side of said third longitudinal member.

15. The apparatus of claim 14 wherein:

a. said first portion and said second portion join to form a fourth longitudinal member, said inner edge of said first portion and said inner edge of said second portion joining to form a continuous inner edge of said fourth longitudinal member, and said outer edge of said first portion and said outer edge of said second portion joining to form a continuous outer edge that joins said second side of said second longitudinal member to form a third longitudinal juncture; and b. said third portion and said fourth portion join to form a fifth longitudinal member, said inner edge of said third portion and said inner edge of said fourth portion joining to form a continuous inner edge of said fifth longitudinal member, and said outer edge of said third portion and said outer edge of said fourth portion joining to form a continuous outer edge that joins said second side of said third longitudinal member to form a fourth longitudinal juncture.

16. The apparatus of claim 1 wherein:

a. said first reinforcing member and said second reinforcing member join to form a fourth longitudinal member, said inner edge of said first reinforcing member and said inner edge of said second reinforcing member joining to form a continuous inner edge of said fourth longitudinal member, and said outer edge of said first reinforcing member and said outer edge of said second reinforcing member joining to form a continuous outer edge that joins said second side of said second longitudinal member to form a third longitudinal juncture; and b. said third reinforcing member and said fourth reinforcing member join to form a fifth longitudinal member, said inner edge of said third reinforcing member and said inner edge of said fourth reinforcing member joining to form a continuous inner edge of said fifth longitudinal member, and said outer edge of said third reinforcing member and said outer edge of said fourth reinforcing member joining to form a continuous outer edge that joins said second side of said third longitudinal member to form a fourth longitudinal juncture.

* * * * *